United States Patent [19]

Guthrie et al.

[11] Patent Number: 4,928,748

[45] Date of Patent: May 29, 1990

[54] CONTINUOUS CASTING OF THIN METAL STRIP

[75] Inventors: Roderick I. L. Guthrie, Quebec, Canada; Joseph G. Herbertson, New South Wales, Australia

[73] Assignee: R. Guthrie Research Associates Inc., Westmount, Canada

[21] Appl. No.: 190,916

[22] Filed: May 6, 1988

[30] Foreign Application Priority Data

May 6, 1987 [CA] Canada ..... 536533

[51] Int. Cl.[5] ..... B22D 11/06; B22D 11/10

[52] U.S. Cl. ..... 164/479; 164/133; 164/134; 164/428; 164/429; 164/432; 164/437; 164/480; 164/481; 164/488

[58] Field of Search ..... 164/488, 437, 133, 134, 164/479, 480, 481, 428, 429, 432; 222/594, 591

[56] References Cited

U.S. PATENT DOCUMENTS

| | | |
|---|---|---|
| 3,006,473 | 10/1961 | Gambler . |
| 3,354,937 | 11/1967 | Jackson, Jr. . |
| 3,530,929 | 9/1970 | Harders et al. . |
| 3,583,474 | 6/1971 | Properzi . |
| 4,086,952 | 5/1978 | Olsson . |
| 4,501,317 | 2/1985 | Sokolowski . |
| 4,614,222 | 9/1986 | Maringer . |
| 4,646,812 | 3/1987 | Maringer . |

FOREIGN PATENT DOCUMENTS

| | | | |
|---|---|---|---|
| 56-4351 | 1/1981 | Japan | 164/437 |
| 57-103762 | 6/1982 | Japan | 164/437 |
| 58-179551 | 10/1983 | Japan | 164/488 |
| 60-216955 | 10/1985 | Japan | 164/437 |
| 61-78538 | 4/1986 | Japan | 164/488 |
| 345933 | 3/1931 | United Kingdom | 222/591 |
| 1396701 | 6/1975 | United Kingdom . | |
| 2017548A | 10/1979 | United Kingdom . | |

*Primary Examiner*—Nicholas P. Godici
*Assistant Examiner*—J. Reed Batten, Jr.
*Attorney, Agent, or Firm*—Rogers & Scott

[57] ABSTRACT

Apparatus for continuous casting includes a tundish for containing molten metal and delivering the metal to a work zone where the metal solidifies as it is moved through the work zone in a continuous casting process. The tundish contains molten metal and includes an outlet and a pervious flow restricting element is positioned in the outlet. The element causes the flow of the metal to be distributed as it flows through the outlet and into the work zone to engage a growing shell of solid metal carried through the work zone by a chilled substrate. The molten metal acts to apply a pressure on the shell and to lubricate the moving shell. The arrangement minimizes exposure of liquid to air and minimizes opportunity for turbulence in the liquid contained in the work zone. A method of continuous casting is also described.

18 Claims, 7 Drawing Sheets

CONTINUOUS CASTING OF THIN METAL STRIP

This invention relates to the continuous casting of thin strip metal having a thickness of about 1 to 20 millimeters and up to about 2 meters wide,. In particular, the invention may be used for the production of low carbon steel sheet suitable for automotive and similar applications. p The invention will be described with reference primarily to steel making but it will be appreciated that the invention can be useful in continuous casting other metals and alloys.

Conventionally, steel, in various cross-sections, is produced by rolling a cast ingot through a number of mills to produce shapes of reduced cross-section as required. The thinner the product, the more passes are required through the rolling mill. In order to save costs, a number of continuous casting methods have been developed in which the casting product dimensions approach the dimensions of conventional hot rolled product. In this way, conventional hot rolling operations can largely be bypassed and the capital cost of machinery and labour reduced substantially. However, the methods to date do not permit making a strip commercially in the mid-range sizes, i.e. from about 1 to 20 millimeters in thickness.

One method now used to make a continuous cast strip involves first receiving melt in a vertical chill mould. The method is usually used to produce slabs having thicknesses in the range of about 150 to 300 millimeters and these slabs are subsequently hot rolled to reduce their thickness. One of the main problems encountered in vertical continuous casting is the tendency for the casting to adhere to the work zone wall thereby producing a solidifying metal skin which may rupture within the mould due to the relative movement between the skin and the mould wall. This problem has been alleviated somewhat by the use both of oscillating moulds which reciprocate vertically for predetermined distances at controlled rates during casting and by the use of lubricating fluxes. Nevertheless, as section thicknesses are decreased, it becomes necessary to increase the metal velocity through the mould so as to maintain reasonably high tonnages of the order of 100 tons per hour per meter width of product. In the 1 to 20 millimeter thickness range, this results in an unacceptable likelihood of skin rupture within the mould.

The problem of surface quality defects caused by relative movement between solidifying metal and a mould can be overcome by using a twin roll caster of a type originated by Bessemer in 1865. In this method, molten metal is poured between two spaced water cooled rolls rotating inwardly towards the metal and solidification takes place at the roll nip. In this way, a continuously moving mould surface is provided and the undesirable consequences of the differential velocity between solidifying metal and a mould are substantially eliminated. While it is possible to produce steel strip having a thickness of 1 to 20 millimeters using a twin roll caster, it becomes necessary to increase the size of the rolls to perhaps unreasonable proportions (e.g. 3 m diameter for 12 mm thick product assuming a maximum subtended pool angle of 60° and a solidification constant of 20 mm/min$^{\frac{1}{2}}$) to provide sufficient residence time for cooling if throughputs in the order of 100 tons per hour per meter width of product are to be achieved.

Other problems which the Bessemer type method does not readily overcome include melt edge containment, exposure to air, surface lapping marks, and providing a consistent liquid metal feed uninterrupted by turbulence.

Another approach to providing a continuously moving mould surface is to cast onto a single roll. For example, in the "melt drag" method, a molten meniscus exiting from an orifice is dragged onto a cooled, rotating drum. The molten metal solidifies upon contacting the metal drum and is then stripped as the drum rotates. Because the metal solidifies primarily from one side only, and because the residence time on such a drum is short, if the proportions of the drum are to be within reasonable limits the thickness of the strip is limited to a maximum of about 1 to 2 millimeters. Similar thickness limitations apply to a variant of this process known as planar flow casting. It is also to be noted that such methods fail to provide adequate loading on the solidifying metal to give a pressurized liquid pool and hence a good surface finish.

In U.S. Pat. No. 4,646,812 to Maringer, a process is proposed for casting metallic strips thicker than those made by the melt drag. Maringer teaches a process in which molten metal is delivered from a tundish to a moving chill surface, the tundish having a slot-like discharge opening at an upstream end to cast metal into a channel defined by the bottom surface of the tundish and the chill surface. The molten top surface of the metal cast exiting the channel is "squeegeed" at a downstream end by a roll.

This is in contrast to the process proposed in U.S. Pat. No. 4,086,952 to Olsson in which a casting station comprises a chill surface moved continuously in contact with a pool of molten metal supplied from a first tundish having an open bottom. The thickness of solidified strip is increased at a succession of casting stations provided in series to a required height.

The bottom of the tundish in the Maringer process defines a floor or element which, when compared with Olsson will limit the effects of convection in the molten metal pool adjacent the solidifying metal. The residence time on Maringer's chill surface beneath the tundish is controlled by the rate of flow of molten metal through the slot-like discharge opening and the speed of the chill surface. Maringer also describes a maximum thickness of cast strip limited to the inherent normal thickness of a cast metal attributable to surface tension.

Another patent of interest is U.S. Pat. No. 3,354,937 to Jackson which describes a tundish provided with an orifice plate at the bottom to deposit dashes of molten metal which freeze instantaneously initially onto a moving chill surface and subsequently on top of frozen metal. The maximum thickness of cast strip which can be obtained in a reasonable time period is limited.

Another method of casting onto a single roll is known as dip casting. In this method, a water cooled cylinder is rotated in a liquid metal bath and a cast strip is peeled from the cylinder as it emerges from the bath. This method of producing strip suffers from technical and complex engineering limitations such as edge control and redistribution of solute elements during solidification.

Still another method of continuously casting metal onto a single continuously moving mould surface is an open trough horizontal casting method in which molten metal is poured onto a series of chill moulds or a moving belt. While it is possible to produce strip having a thickness of 12 to 20 millimeters at reasonable production rates, the surface quality of the sheet tends to be poor because of exposure to air which allows oxidation, turbulence effects, and the entrapment of gases below an upper skin formed by radiative heat losses.

Similarly, with free pouring, the lower surface of the casting exhibits cold shuts and lap defects if using a direct chill metal mould. This can be solved by the provision of a thermally insulating layer which carries a high cost penalty for thin strip casting.

Still another approach is to provide a continuously moving mould such as that found in the twin belt caster developed by Hazelett. In this structure a pair of thin steel belts move in parallel with one of the belts carrying a continuous chain of dam blocks to define the sides of the mould. A major problem arises when applying this process to the production of thin strip because it is both difficult to provide uniform delivery through the inlet and to match the speed of the belt with the demand for liquid metal. A further problem exists when using narrow and wide pouring nozzles, as freezing occurs between the nozzle and the belts and this interferes with metal delivery to the mould. Similarly, erosion of the nozzle caused by high velocities of steel passing through it can be a problem. Alternatively, if nozzles are not used, the liquid is poured into an open pool which is susceptible to reoxidation.

In view of the above, an object of this invention is to provide a method of continuously casting metal in the form of a strip or thin slab having a thickness in the range of about 1 to 20 millimeters and in production rates which can be of the order of 100 tons per hour or more per meter width of product It is also an object to achieve these rates while at least minimizing the above described problems, namely: skin friction between a solidifying shell and a cooled mould surface, opportunities for reoxidation, turbulence related defects, premature and irregular freezing at chill surfaces, and poor surface quality resulting from inadequate feed control In accordance with a first aspect of the invention there is provided a tundish for containing molten metal and delivering the metal to a work zone where the metal solidifies as it is moved through the work zone in a continuous casting process, the tundish comprising means for containing the molten metal and including an outlet, and a pervious flow restricting element positioned in the outlet to permit flow of molten metal into the work zone, the element causing a pressure drop in the flow of the metal across the element and the flow through the element being distributed throughout the pervious element, the element also providing a temperature gradient between the molten metal in the tundish and the work zone to permit the tundish to contain molten metal at elevated temperatures while the molten metal entering the work zone is near the solidus/-liquidus temperature of the metal.

The invention also provides a method and apparatus for using the tundish in association with a chilled substrate moving through the work zone.

In accordance with a second aspect of the invention there is provided an apparatus for casting metal continuously in strip form, the apparatus comprising a tundish for containing molten metal and having an outlet through which the molten metal flows under pressure into a work zone having upstream and downstream ends, a travelling chilled substrate positioned to receive the molten metal in the work zone and movable from the upstream to the downstream end of the work zone, means adapted to drive the substrate at a selected velocity, and a pervious flow restricting element at the outlet of the tundish and having an effective cross-section for flow sufficiently large to maintain a significantly smaller velocity of molten metal flow through the element than the velocity of the substrate, the element being positioned to maintain essentially non-turbulent flow as the molten metal meets the substrate and solidifies as a shell on the substrate, and to provide space for a layer of molten metal under pressure and in lubricating contact with the element.

A third aspect of the invention provides a method of continuously casting molten metal comprising the steps of pouring the molten metal at a selected supply rate through a pervious flow restricting element having an inlet surface in fluid communication with a supply of molten metal and an outlet surface in fluid communication with a work zone where the metal is restrained and shaped, and wherein the fluid communication is established by a plurality of openings extending along the width and length of the element, cooling the metal to cause at least some of it to solidify against a chilled substrate passing through the work zone, and maintaining a depth of molten metal adjacent to the outlet surface of the element sufficient to provide lubrication between the outlet surface and the solidifying metal without significant turbulence, and driving the substrate at a rate commensurate with the molten metal supply rate and adapted to ensure that a constrained pool of molten metal is maintained in the work zone under positive pressure to enhance the finish on the solid metal in contact with the substrate.

A fourth aspect of the invention provides a method of continuously casting metal strip of a selected transverse cross-sectional area, the method comprising the steps providing molten metal above a pervious flow restricting element for delivery through the element to a chilled movable substrate, the element having an effective total cross-sectional area for flow which is substantially greater than said cross sectional area, flowing the molten metal through the element at a selected average velocity and receiving the molten metal in a work zone defined by the chilled movable substrate, an upstream edge structure, and side edge structures extending between the upstream edge structure, and a downstream edge structure spaced from the chilled movable substrate to define an exit where the cast strip leaves the work zone, the flow of molten metal into the work zone maintaining a positive pressure in the work zone, driving the chilled movable substrate at a second velocity greater than said average velocity of the molten metal through the element so that a constrained pool of metal fills the work zone and a shell of solidified metal grows on the substrate under said positive pressure with molten metal acting as a lubricant between the element and the shell, and said element being positioned relative to the substrate to minimize turbulence in the molten metal contained in the work zone.

These and other aspects of the invention will be described with reference to the drawings, in which.

As mentioned previously, the invention will be described with reference to the production of steel strip having a thickness in the range of about 1 to 20 millimeters and a width preferably in the range of 1 to 2 meters. However, this description is purely exemplary and it will be clear to those skilled in the art that these parameters can vary and that the apparatus can be used to cast non-ferrous metals in continuous strip form, in which case, the above-mentioned dimensional parameters will also vary. Also, in this example, the steel would typically be a low carbon steel killed with aluminum or silicon.

Figure 1:
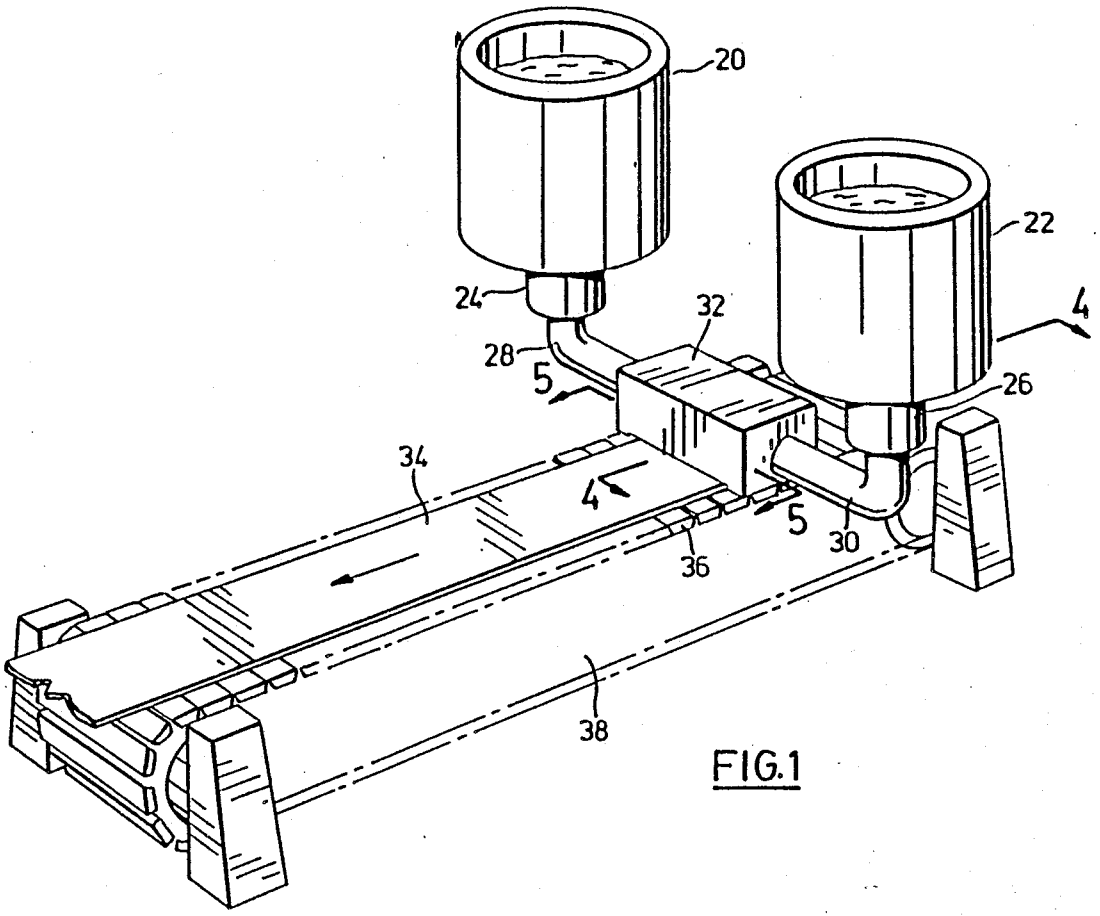
FIG. 1 is a schematic representation drawn in perspective to show apparatus incorporating a preferred embodiment of the invention.

As seen in FIG. 1, steel is fed directly from one of two ladles 20, 22 via control valves 24, 26 which are used to selectively receive molten metal from one of the ladles while the other is being replenished. The melt passes via insulated ducts 28, 30 to a tundish 32 which, as will be described, defines downstream, upstream and side edge structures of a work zone 44 (FIG. 2) for cast strip 34 leaving the tundish carried by a substrate 36 in the form of a generally horizontal endless belt forming part of a chill transporter arrangement 38. In this specification, the term "endless belt" will be understood to include a continuous belt or a series of blocks arranged to form a belt (sometimes known as a "block caster"). The parts are of course shown diagramatically and such devices as the transporter 38, ladles 20, 22 and valves 24, 26 are intended to represent conventional devices Reference is next made to FIGS. 2 to 5 which show various views of the preferred embodiment of the invention. The operatively lower portion or floor (as drawn) of the tundish 32 defines a flow restricting element 40 to deliver molten metal 42 to the substrate 36 and to provide molten metal flow with a selected average velocity. The element 40 is in the form of a reticulate medium which defines a plurality of passages wherein the effective total cross-sectional area is substantially greater than the transverse cross-sectional area of the cast strip 34 so that the average velocity through the passages is substantially less than the velocity of the cast strip. This minimizes the risk of turbulent flow in the work zone 44 where the molten metal leaving the element 40 is restrained and shaped as will be described, and also minimizes the risk of refractory erosion problems normally associated with narrow slot nozzles.

Figure 2:
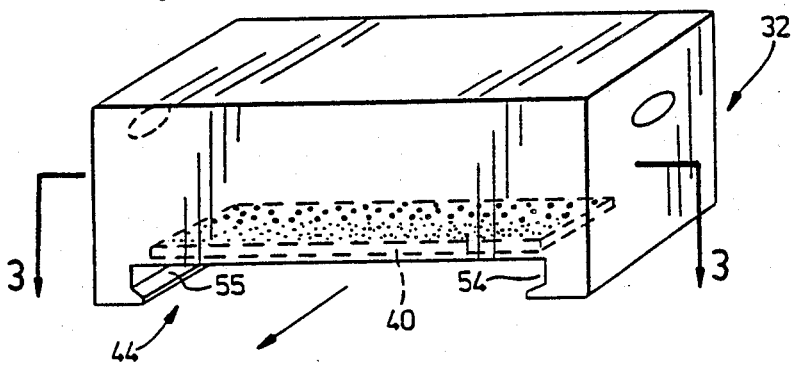
FIG. 2 is a schematic perspective view of a tundish used in the preferred embodiment.
Figure 3:
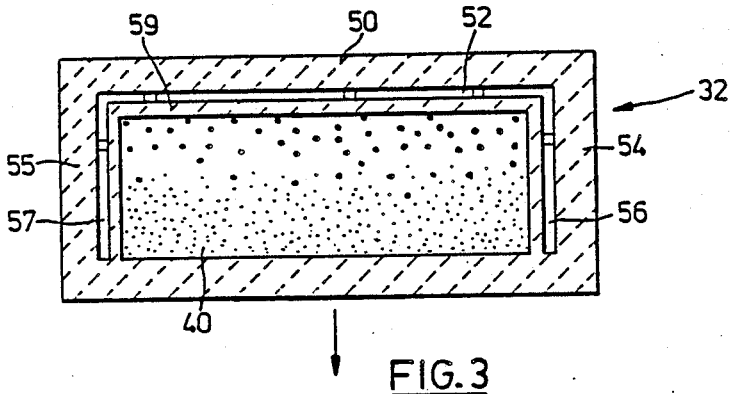
FIG. 3 is a sectional plan view on line 3—3 of FIG. 2.

The work zone 44 is defined in part by substrate 36 which moves from an upstream end 46 of the work zone to a downstream end 48 where the cast strip 34 exits from the work zone. An upstream edge structure 50 forming part of the work zone is spaced from the element 40 at an area designated by numeral 52 to allow relatively unconstrained liquid metal flow into the work zone 44. Similarly, and as can be seen in FIGS. 2 and 3, side edge structures 54, 55 are spaced from the element 40 at areas designated by numerals 56, 57 (FIG. 3). In this way a molten metal separation is maintained between the solidifying metal shell 58 and the stationary edge structures of the work zone. It will be understood that the spaces 52, 56, 57 are dimensioned to allow just enough molten metal to flow around the element 40 to maintain a lubricating layer of molten metal around the cast strip without causing any turbulence of the molten metal in the work zone. It will be appreciated that the spaces 52, 56, 57 may be substituted by a porous medium causing a lower pressure drop in the molten metal passing through it than through the associated flow restricting element 40.

To reduce erosion of the element 40, its peripheral edges are framed in a skirt 59 made of impervious material which conveniently is the same material comprising the stationary edge structures of the work zone. The upstream portion of the skirt 59 also forms an upstream edge structure for the work zone which is spaced from the substrate 36 to define an exit where the cast strip 34 leaves the work zone 44.

Figure 4:
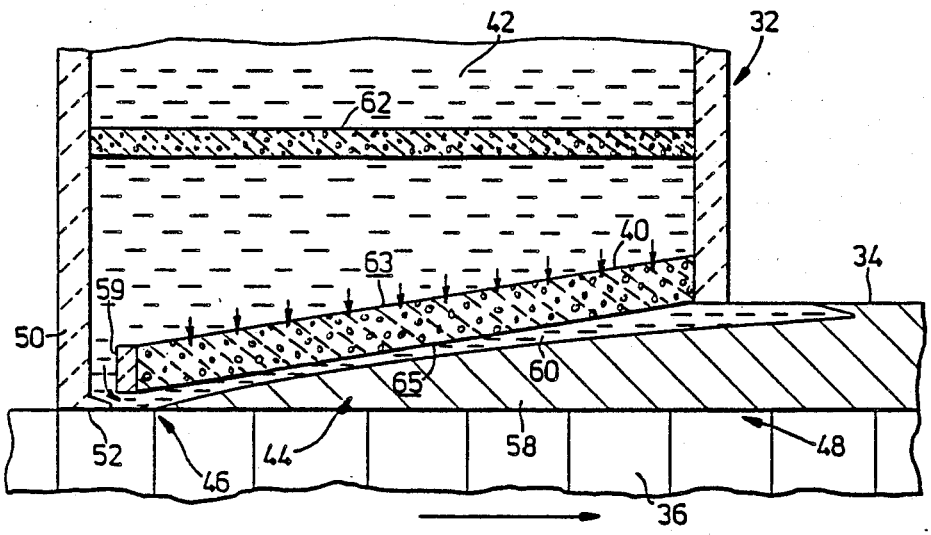
FIG. 4 is a sectional view taken generally on line 4—4 of FIG. 1 and showing the preferred embodiment of the apparatus according to the invention to a larger scale.
Figure 5:
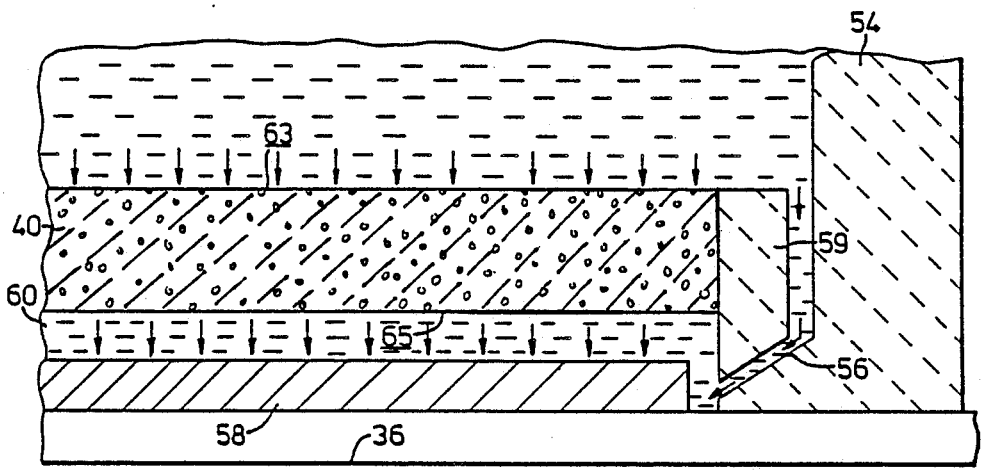
FIG. 5 is a sectional view on line 5—5 of FIG. 1 and also drawn to a larger scale.

As seen in FIG. 4, the thickness of a shell 58 increases as the substrate 36 carries the shell 58 from the upstream to the downstream end of the work zone 44. The velocity of the substrate 36 is selected so that as the shell 58 grows, a molten metal boundary 60 is maintained between the shell 58 and an outlet surface 65 of the element 40. As this molten metal boundary 60 is maintained in proximity with all of the stationary parts of the work zone 44, it acts as a lubricant to ensure that there is no contact between the solidifying shell 58 and the stationary parts while forming an airtight seal to prevent oxidation.

It will be appreciated that there will be some molten metal resident on the shell as the shell leaves the work zone and this can be protected from oxidation by using any conventional gas shrouding techniques.

As seen in FIG. 4, a filter 62 is provided in the tundish above the element 40 to minimize the risk of contaminating particles reaching an inlet surface 63 of the element 40 in fluid communication with the molten metal held in the tundish 32. Moreover, it will be understood that where the element 40 is made of a reticulated medium it also will operate as a filter to further ensure that the molten metal delivered to the work zone is substantially free of any solid inclusions. With reference to purity, it will be recognized that because the tundish 32 is in airtight communication with the ladles 20, 22 and also because the flow from a ladle occurs at the bottom of the ladle, the steel should be clean and the resulting strip 34 should be essentially free of larger non-metallic inclusions.

It is also significant to note that a static pressure is maintained throughout the work zone 44 to enhance the bottom surface finish of the solidifying shell 58. This growing shell 58 is designed to be sufficiently thick at the exit from the work zone to maintain a back pressure in the work zone.

It will of course be appreciated that the system is designed so that the full static pressure of the ladle is not applied to the element 40 and that the pressure drop across the filter 62 is taken into consideration when designing flow rates through the element 40 into the work zone 44.

The static pressure is a function of the head in the tundish and the pressure drop across the element 40.

This pressure drop is related to pore size, element thickness and the type of material used. Also, by varying the porosity of the element, the static pressure can be changed between the upstream and downstream ends of the work zone as required to control molten metal flowing into the work zone and to ensure both that the work zone is full and that the head is not so high as to drive excessive molten metal out of the downstream end of the work zone.

Taking a specific example of steel flowing through channels at a rate of 100 tph/meter width, it is well known from the Hagen-Poiseuille law for laminar flow of liquid through a channel, that the flowrate is related to channel radius, R, channel length, L, liquid viscosity, $\mu$, and overall pressure drop across the filter caused by this flow ($P_O$-$P_L$) according to $$Q = \frac{\pi(P_0 - P_L)R^4}{8\mu L}$$

The total flow through a plate structure of area $A_r$, containing N channels will be $Q_T$=NQ. N can be related to $\epsilon$, porosity, for a reticulate medium according to $$N = \frac{\epsilon A_T}{\pi R^4}$$

Figure 12:
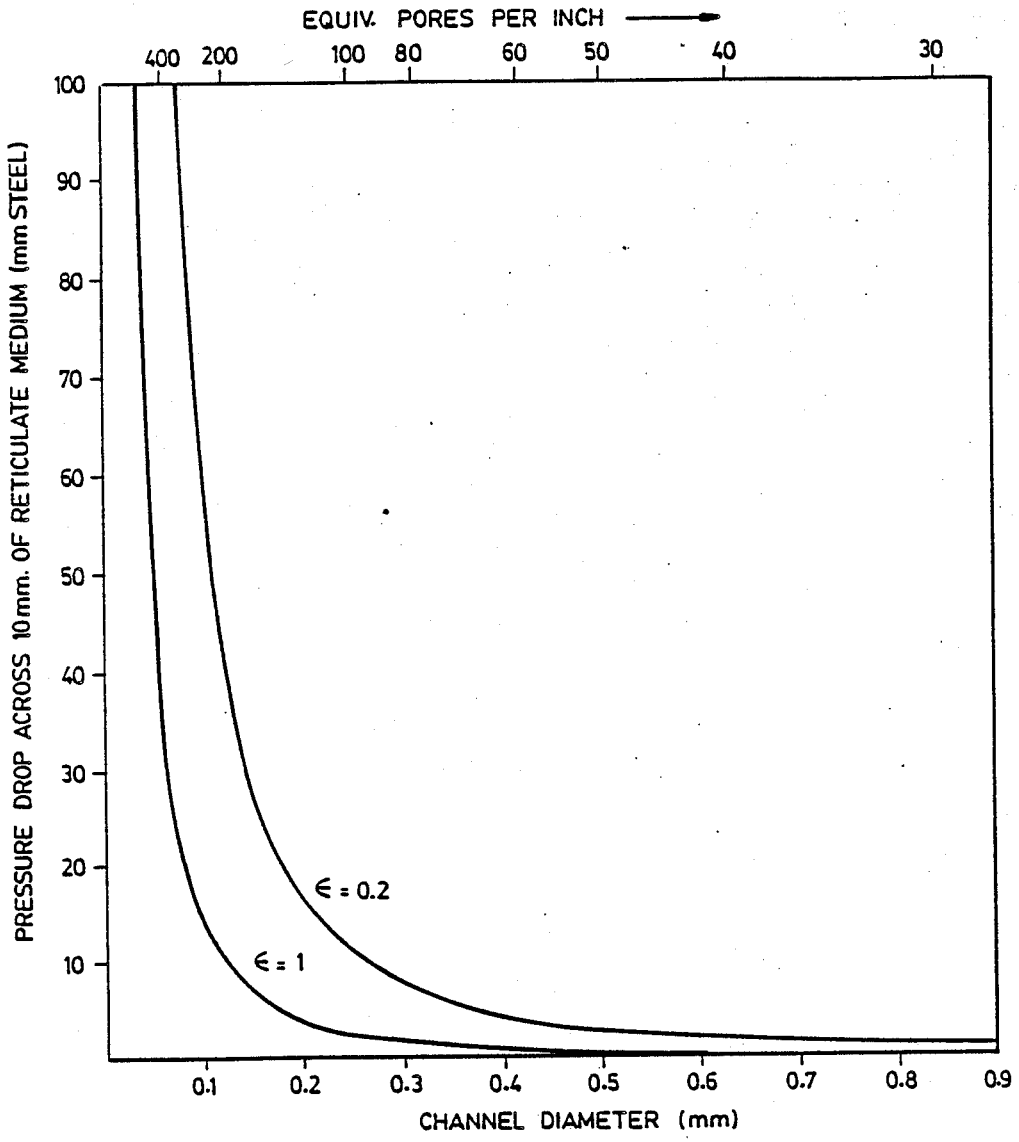
FIG. 12 is a graphical representation showing the relation between pressure drops and channel diameter for flow restricting elements according to the invention having porosities of 1 and 0.2.

On the basis of these relationships, FIG. 12 has been prepared which shows a theoretical estimate of the way in which the pressure across a flow restricting element of 10 mm thickness varies with channel diameter (mm) when steel is flowing into a 1 meter long work zone at a rate of 100 tons per hour/meter width. A reticulate structure with a porosity $\epsilon$ approaching unity, would (for instance), result in a pressure drop of 10 mm of steel if its corresponding pores (channels) were 0.125 mm diameter (equivalent to 200 pores per inch assuming wall thickness between channels to be negligible). Tortuosity factors and changes in passage diameter will cause greater energy losses, and therefore greater pressure drops in practice.

For a ceramic material containing passageways, such that $\epsilon$=0.2, the pressure drop across the flow restricting medium will be correspondingly greater as shown in FIG. 12.

It should be noted that the pressure drop can be reduced locally near the edges of the element by proportioning the spaces 52, 56 and 57 (FIG. 3). In particular, if space 52 is widened, there will be a strong flow at the upstream end of the work zone in the direction of travel of the substrate. The reticulate medium 40 is preferably of a ceramic type sold under the trade mark RETICEL by Hi-Tech Ceramics, Inc. of Alfred, N.Y., U.S.A. However, materials having similar characteristics can of course be used such as the Selec/Fe filters produced by the Ceramic Foam Filter Division of Consolidated Aluminum in Hendersonville, North Carolina. Others include the CLEAN-CAST (TRADE MARK) ceramic filter flow modifer by C-E Refractories which are fabricated in the form of a plurality of square shaped passageways of various lengths, resembling the form of a honeycomb in appearance. Tests carried out at McGill University in which molten steel is passed through stabilized zirconia material show reticulate material whose porosity varies between 10 and 80 pores per inch to be satisfactory for controlling flows. At the higher porosities, it may be necessary to prime the element under a positive pressure to establish liquid metal flow.

It will now be appreciated that in general the work zone 44 is filled by molten and solidifying metal as the metal travels with the substrate 36 out of the work zone.

The divergence shown in FIG. 4 between the substrate 36 and the element 40 matches the growth of the shell 58 to maintain the liquid boundary 60. The angle shown on the drawing is an exaggeration for the purposes of description and this divergence will to some extent be determined by experimentation with flow rates and other variables. For example although the exemplary construction is to be preferred, it may be varied by changing the arrangement of the element 40, substrate 36 and stationary edge structures as long as a filled work zone is maintained under some pressure to ensure adequate reactive forces with the substrate to provide an acceptable surface finish on the resulting strip and a sound casting. This is because the continuous static pressure in the work zone maintains constant contact between the molten and solidifying metal to ensure that contraction voids are filled as they form.

Figure 9:
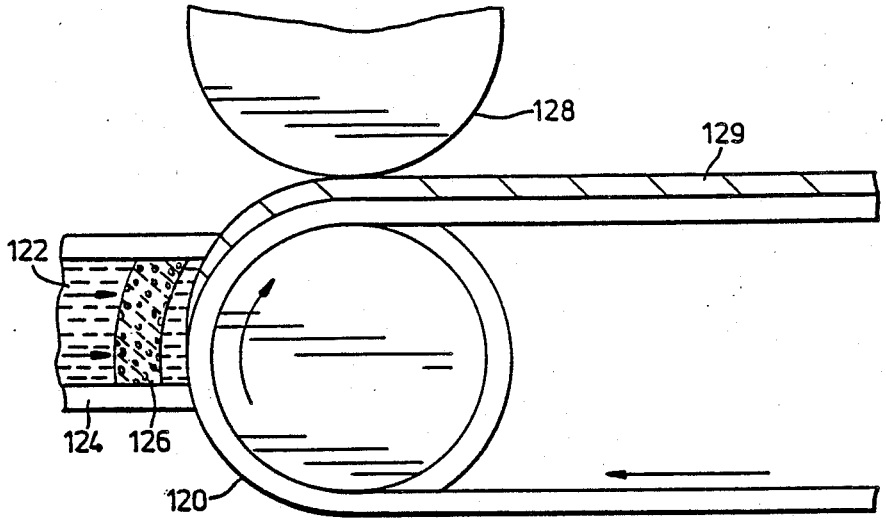

Variations can be made with respect to the substrate itself which could of course be any moving medium suitable for receiving and solidifying the metal as described fully below with reference to FIGS. 9 and 10. It will also be understood that the lateral edges of the substrate opposite to the edge structures 54, 55 will be insulated in conventional manner to ensure that the metal in the spaces 56, 57 does not freeze. This may be done in a block caster by inserting ceramic blocks in parallel edge portions of the belt which lie outside a central chilled portion.

The element 40 also has an effect on the temperature gradient between the molten metal above the element 40 and the metal in the work zone. This is because the element 40 has a discrete thermal conductivity which permits maintaining the molten metal in the tundish at an elevated or superheated temperature while the metal below the element is at the temperature desired for controlled freezing in the work zone, i.e. close to the solidus/liquidus temperature. Also, any convection or other turbulence in the tundish is isolated by the element 40 from the work zone 44 so that the flow into the zone is without excessive turbulence and has a low Reynolds number through the passages into the work zone.

Figure 6:
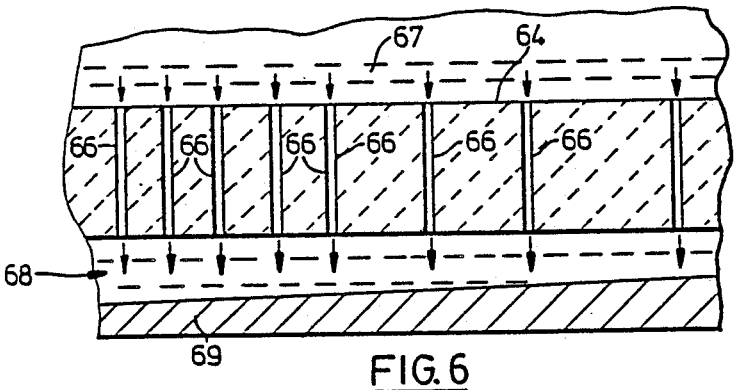
FIG. 6 is a view similar in most respects to FIG. 3 drawn on the same page as FIGS. 2 and 3 illustrating an alternative embodiment of the apparatus and including a flow restricting element.

Reference is next made to FIG. 6 (adjacent FIG. 3) which illustrates an alternative flow restricting element 64 in the form of a ceramic plate cast to include channels 66 of uniform cross section extending between inlet and outlet surfaces of the element 64 and which allow molten metal 67 to flow into a work zone 68 for solidification into a shell 69 growing between an upstream end and a downstream end of the work zone 68. The arrangement of the passages 66 can of course be varied in size and in distribution to provide different flow rates in different parts of the work zone. For example, in the embodiment illustrated, the number of passages 66 is greater at the upstream end than at the downstream end of the work zone 68 so as to deliver a greater volumetric flow of molten metal near the upstream end. This results in a greater static head at the upstream end to pressurize metal at the line of initial freezing and produce a better surface finish Alternatively, a variation in flow rate through the element may be produced by using a reticulated structure of variable porosity, and could for example, include a element having 20 p.p.i. (pores per linear inch), each pore having a theoretical diameter of 1.27 mm, at the upstream end of the work zone and 65 p.p.i., each pore having a theoretical diameter of 0.39 mm, at the downstream end of the work zone. A sliding gate may also be spaced above the inlet surface of the element to cause molten metal to flow preferentially towards the element at the upstream end while continuing some flow of molten metal to the downstream end to ensure that a layer of molten metal is maintained for lubrication and for filling shrinkage voids. The selection of the size of the passages and their distribution will depend upon the shape of the work zone and will be consistent with maintaining a filled work zone subject to a positive pressure. A further advantage to this practice is that it allows the inflowing metal to rapidly assume parallel motion with respect to the solidifying metal substrate, thereby allowing controlled exit flows and avoiding short circuiting of metal through the reticulate medium near the exit.

Figure 7:
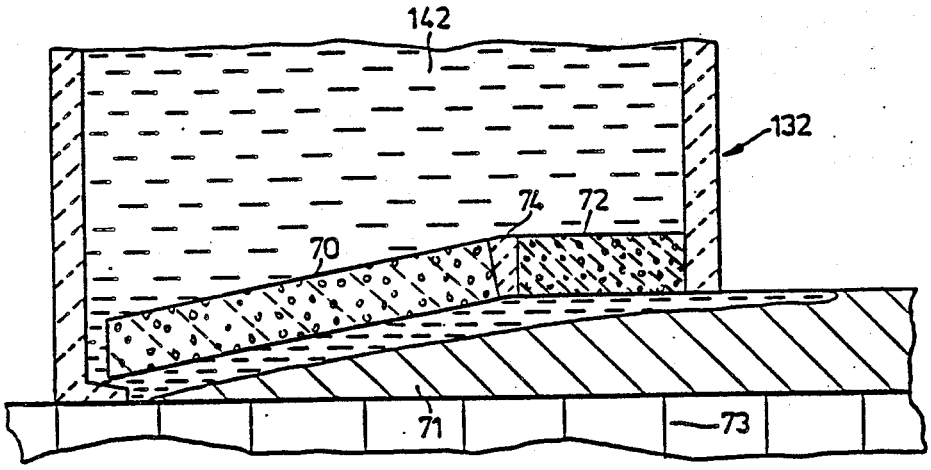
FIGS. 7 to 10 are views similar to FIG. 4 illustrating further embodiments of the invention.

Reference is next made to FIG. 7 to illustrate a further variation within the scope of the invention. In this instance, a high pressure is assured where a shell 71 is first grown so that the shell is in firm contact with a chilled movable substrate 73 for improved surface quality. Upstream and downstream elements 70, 72 are used in a tundish 132 supported by a common brace 74. The upstream element 70 is angled and made from a reticulate or perforated material to provide passages which allow a greater rate of flow of molten metal 142 than in the horizontal downstream element 72. As a result of the freer flow through element 70, the shell 71 is formed under pressure and the shell is lubricated as it solidifies by molten metal entering through the element 72.

This ensures that the shell 71 is strong enough to withstand thermal and physical loading from the molten metal so that it maintains its dimensional stability as the metal freezes to increase the thickness of the shell up to the thickness of the final strip.

Figure 8:
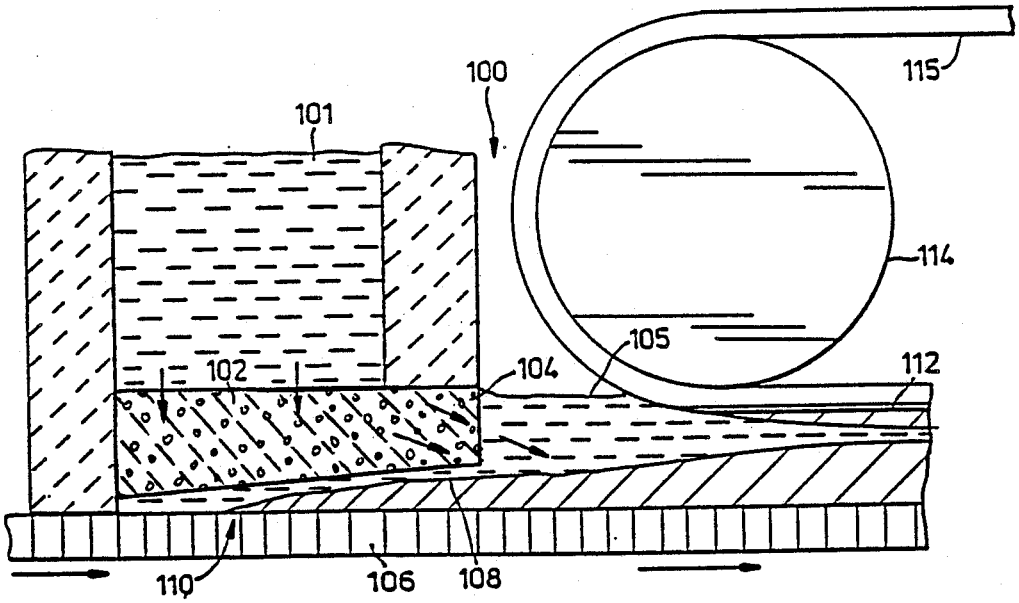

Reference will now be made to FIG. 8 in which a tundish generally indicated by numeral 100 for supplying molten metal 101 and having a pervious raised floor defining an element 102 includes a downstream edge structure 104 spaced from a chilled moving substrate 106 to define an exit for a solidifying metal shell 108 in which the downstream edge structure 104 is made of a pervious material and is continuous with the element 102. The pervious edge structure 104 is adapted to deliver molten metal downstream of a work zone 110 for shaping and restraining the molten metal 101 and is defined by the substrate 106 and lower walls of the tundish 100. The edge structure 104 delivers molten metal at substantially the same velocity as the velocity of the shell 108 leaving the work zone 110.

Such a tundish is adapted to ensure delivery of molten metal at the downstream end of the work zone 110 to minimize the likelihood of any sticking or freezing of the upper surface of the shell 108 to the upstream edge structure 104 as it exits the work zone. The consequent development of transverse cracking of the surface of the shell generated during such freezing is substantially eliminated and the molten metal supply will blanket the shell from thermal shock as well as equalize the upper surface of the shell so that it is smooth.

The flowrate of molten metal through the upstream edge structure 104 may be controlled in response to sensing the level of molten metal 105 downstream of the tundish 100 by adjustment of the pressure indicated at $P_A$ at the upper free surface of the molten metal within the tundish. For example, a supply of inert gas such as argon can be maintained at pressure on this surface. The material for constructing the downstream edge structure 104 may also be selected to provided a selected pressure drop.

To perserve good metal quality in the resulting cast strip 112, the molten metal 105 may be shrouded in inert gas, optionally heated to produce a controlled thermal gradient in the cast strip. Further, work rolls 114 (only one of which is shown) driving a belt 115 are placed downstream of the work zone near the interface between molten metal and the cast strip 112 so as to impart an acceptable finish to the upper surface of the strip remote from the chilled movable substrate and to contain the molten metal 105 outside the tundish. This will be supplemented with edge dams to prevent any spilling.

It will be appreciated that use of the tundish of Fig. 8 produces a cast strip of greater thickness than would otherwise be produced without delivery of molten metal outside the work zone.

The structures described are typical of a variety of structures which would satisfy the requirements of the invention consistent with the use of a work zone in which a shell is grown and separated from stationary parts of the work zone by molten metal.

As mentioned, variations may also be made to the chilled movable substrate within the scope of this invention. Mechanical equivalents to an endless belt which are deemed suitable will include a single chill roll arranged so as to have molten metal delivered to the side. Such an arrangement is illustrated in FIG. 9 where the roll is designated by numeral 120 and a tundish for delivering molten metal 122 to the side of the roll 120 is designated by numeral 124. A pervious element 126 extends between upper and lower walls of the tundish 124 and is spaced from the outer ends of the walls adjacent the roll 120. The element also has a curvature which matches generally the shape of the wall 120. It will be appreciated that gravitational forces will contribute to create a greater hydrostatic pressure in the molten metal at the upstream end of the work zone defined by the tundish walls and the roll.

A work roll 128 is placed downstream of the work zone to impart an acceptable finish to the surface of the cast strip 129 remote from the chill roll 120 in the same fashion as described with reference to FIG. 8.

Figure 10:
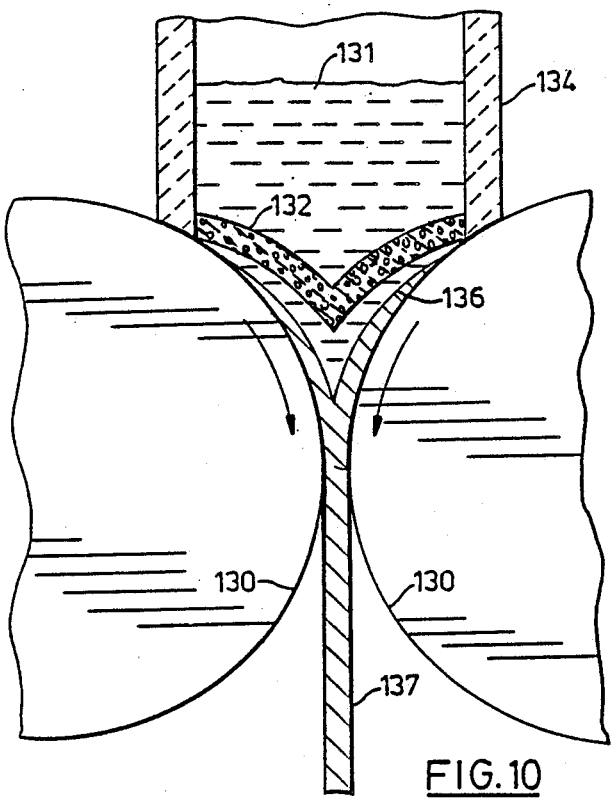

Another equivalent to a chilled endless belt for the purposes of this invention is shown in FIG. 10. Here twin rolls 130 located opposite one another and rotating inwardly towards molten metal carry a growing shell 136 downwardly from an upstream end to a downstream end. The rolls are spaced to receive and chill molten metal 131 delivered through a pervious element 132 supported between the walls of a tundish 134 and spaced from downward ends of the walls adjacent the rolls 130. Again the element 132 has a curvature to match generally the shape of the rolls and has a substantially V-shaped cross-section.

Conventionally, molten metal is delivered to a twin roll continuous caster by submerging a nozzle into a pool of molten metal constrained in the nip between the rolls. Many problems associated with such a system may be overcome in the arrangment of FIG. 10. These problems include entrainment of solid inclusions, turbulence and cross flows in the melt and surface lapping marks in the cast strip.

By using an element 132 according to the invention, the abovementioned problems are addressed. Further, edge containment may be simplified. The resulting cast strip 137 is formed from a quiescent pool of molten metal subject to a hydrostatic pressure to ensure the production of an acceptable finish on both surfaces simultaneously. In addition, the element 132 operates to create a thermal gradient between the molten metal adjacent the rolls 130 and the molten metal in the tundish above the element 132, as described above with reference to the embodiment illustrated in FIGS. 2 to 5.

Still further variations included in the scope of this invention will include use of a tundish having a flow restricting element in association with a twin belt caster in which the belts may adopt a variety of orientations.

Figure 11:
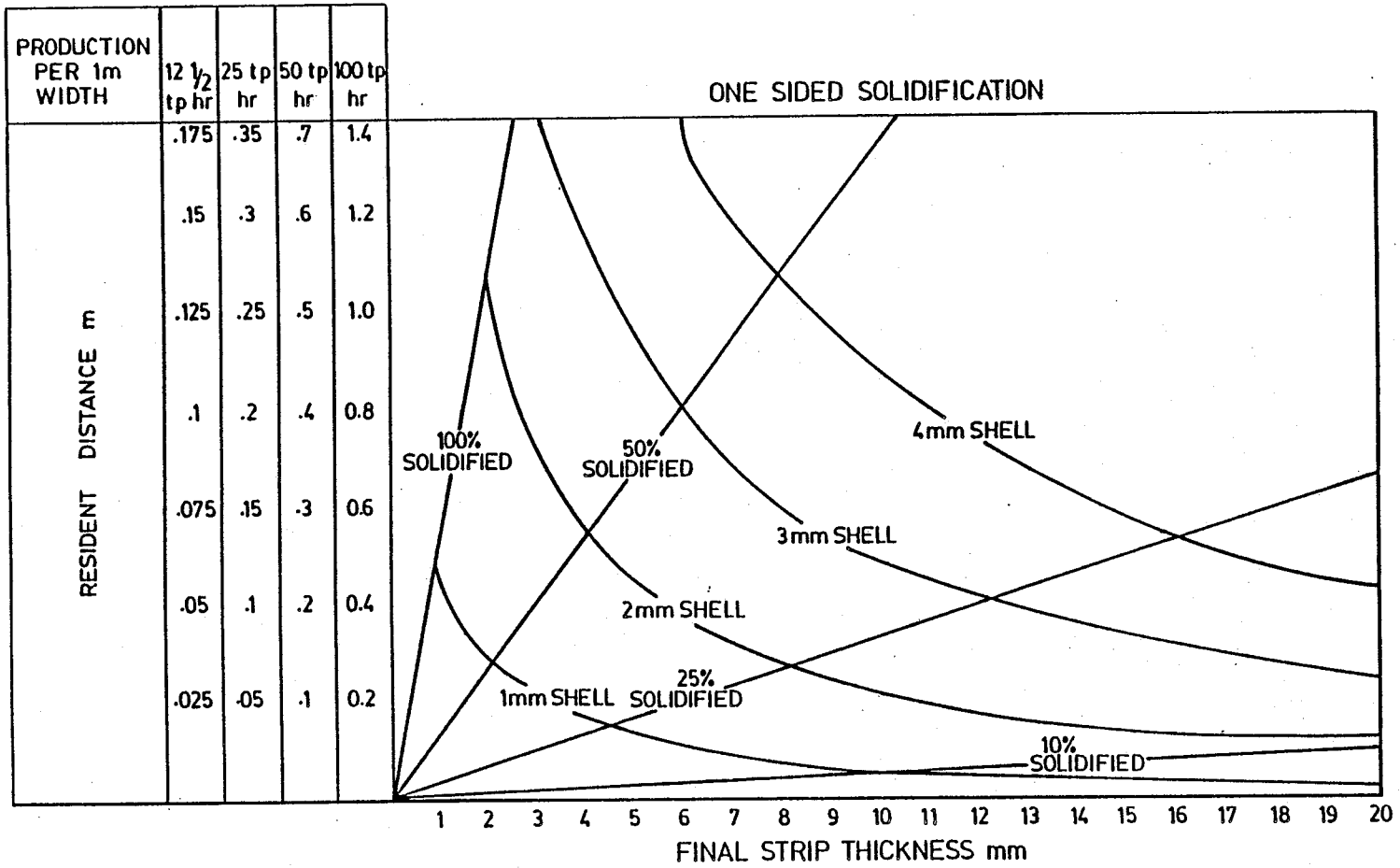
FIG. 11 is a graphical representation of some of the properties of one-sided solidification of steel applicable to the present invention.

Reference is now made to FIG. 11 which demonstrates in a graph some of the limitations of the structure according to the invention. The abscissa represents the required final thickness of the cast strip and is plotted against a series of ordinates for various production rates through the apparatus. As the production rate increases, the resident distance during which molten steel is in contact with the chilled substrate in the work zone increases. Curves are plotted for various shell thicknesses and lines radiating from the origin show fixed percentages of solidification. The graph shows only a portion of the full curves for clarity of presentation.

To demonstrate the graphical representation, consider a strip which is to have a final thickness of 2 millimeters. Reading vertically from the abscissa, the vertical line through the point representing 2 millimeters will reach the 100 percent solidification line at a resident distance of about 1.05 meters for a production rate of 100 tons per hour per meter width of product strip. Similarly for the same strip thickness and a production rate of 25 tons per hour, the resident distance goes down to about 0.26 meters. As the desired strip thickness increases, then clearly the residence time required will also increase depending upon the desired tonnage per hour.

Another approach to using the graph is to consider the percentage of the shell solidification with reference to the eventual thickness of a particular resident distance. For instance, if a final strip thickness of 10 millimeters is required, when a 4 millimeter shell thickness has been reached, the resident distance approaches 0.9 meters for a flow production rate of 100 tons per hour per meter width of product strip. Similarly, for the same final strip thickness the strip will have solidified only 10 percent when it has a resident distance of about 0.05 meters for the same production rate. From this it will be seen that when the higher strip thicknesses are to be met by the apparatus, the resident distance will be significantly longer to ensure substantially complete solidification before the strip leaves the apparatus.

It will be evident that the apparatus and process described can be varied within the scope of the invention as claimed. For example, where the invention is applied to the continuous casting of metals other than steel, flow restricting elements made of other materials than ceramic may be more suitable. In particular, a flow restricting element made of graphite may be used with copper or aluminium metals.

We claim:

1. Apparatus for casting metal continuously in strip form, the apparatus comprising:

a tundish for containing molten metal and having an outlet through which the molten metal flows under pressure into a work zone having upstream and downstream ends;

a travelling chilled substrate positioned to receive the molten metal in the work zone and moveable from the upstream to the downstream end of the work zone, the tundish and the substrate combining to close the said upstream end to substantially exclude entry of air into the work zone through said upstream end, and a portion of the metal flow through the outlet being at the upstream end of the work zone;

means adapted to drive the substrate at a selected velocity; and a pervious flow restricting element at the outlet of the tundish and having an efficient cross-section for flow of molten metal through the element to maintain essentially non-turbulent flow as the molten metal meets the substrate and solidifies as a shell on the substrate, the shell increasing in thickness from the upstream end to the downstream end of the work zone as the molten metal solidifies in the work zone, and the restricting element being spaced from the shell to provide space for a layer of molten metal under pressure and in lubricating contact with th- element such that the molten metal flows from the restricting element onto the shell and then in the direction of motion of the substrate.

2. Apparatus according to claim 1 in which the element defines a raised floor for the tundish, and lower walls of the tundish extending between the element and the chilled substrate define part of the work zone.

3. Apparatus according to claim 1 in which the element is adapted to deliver a greater volumetric flow of molten metal at the upstream end of the work zone than at the downstream end of the work zone.

4. Apparatus according to claim 1 in which the element defines an outlet surface through which the metal enters the work zone and in which the outlet surface of the element and the substrate diverge from the upstream to downstream end of the work zone, the angle of divergence being such that the divergence matches generally the shape of said growing shell of solidified metal.

5. Apparatus according to claim 1 in which the element is of a ceramic reticulate material.

6. Apparatus according to claim 1 in which the element is of a cast ceramic material into which channels have been formed.

7. Apparatus according to claim 1 in which the substrate is defined by an endless belt.

8. Apparatus according to claim 1 in which the substrate is defined by a roll.

9. Apparatus according to claim 1 in which the substrate is defined by a pair of spaced rolls rotating inwardly towards one another in the work zone, the spacing between the rolls determining the strip form.

10. Apparatus according to claim 1 in which the substrate is defined by a pair of belts lying substantially parallel to each other and spaced to determine the strip form, and means to drive the belts with adjacent surfaces moving in the same direction from said upstream end to said downstream end of the work zone.

11. Apparatus according to claim 1 and further including a second movable chilled surface spaced downstream from the substrate and adapted to cool and solidify any molten metal carried by said shell and exiting the downstream end of the work zone.

12. A method of continuously casting molten metal comprising the steps of:

containing the molten metal for flow downwardly into a work zone having a closed upstream and an open downstream end, part of the flow being at the upstream end of the work zone, and at least some of the flow being through a pervious flow restricting element having an inlet surface in fluid communication with the molten metal and an outlet surface in fluid communication with the work zone where the metal is restrained and shaped, and wherein fluid communication is established through said element by a plurality of openings extending along the width and length of the element;

cooling the metal in the work zone to cause at least some of the metal to solidify against a chilled substrate passing through the work zone from the upstream to the downstream end of the work zone to form a growing shell of solidified metal in the work zone;

maintaining a depth of molten metal between the shell and the outlet surface of the element sufficient to provide lubrication between the outlet surface and the solidifying metal without significant turbulence; and driving the substrate at a rate commensurate with the molten metal supply rate and adapted to ensure that the molten metal in the work zone is under positive pressure to enhance the finish on the solid metal in contact with the substrate.

13. A method of continuously casting metal strip of a selected transverse cross-sectional area, the method comprising the steps:

providing a supply of liquid metal above an outlet for flow through the outlet into a work zone;

providing a pervious flow restricting element at the outlet so that at least part of the flow of liquid metal will be through the element, the liquid metal flowing onto a chilled movable substrate, the effective total cross-sectional area for flow through the outlet being substantially greater than said cross sectional area;

flowing the liquid metal through the outlet and receiving and containing the liquid metal in the work zone which is defined by the outlet, the chilled movable substrate, an upstream edge structure and side edge structures extending between the upstream edge structure and a downstream edge structure spaced from the chilled movable substrate to define an exit where the cast strip leaves the work zone, the flow of liquid metal entering the work zone partly adjacent the upstream edge structure and maintaining a positive pressure in the work zone; and driving the chilled movable substrate so that a shell of solidified metal grows as the shell is carried through the work zone by the substrate, the shell being under said positive pressure with liquid metal acting as a lubricant between the element and the shell, such that the lubricating liquid metal meets the shell and moves with the shell towards the exit to minimize opportunity for turbulence in the liquid metal.

14. A method as claimed in claim 13 in which the upstream edge structure is spaced along the substrate from the element to allow for flow of the liquid metal into the work zone generally in the direction of motion of the substrate.

15. A method as claimed in claim 13 in which the side edge structures are spaced from the element to allow for flow of the liquid metal from the sides and into the work zone.

16. A method as claimed in claim 13, in which the element is of a ceramic reticulate material.

17. A method as claimed in claim 13, in which the element is of cast material into which channels have been formed.

18. A method as claimed in claim 13, in which the element defines an outlet surface through which the liquid metal enters the work zone and in which the substrate and the outlet surface of the element diverge in the work zone, the angle of divergence between the outlet surface and the substrate being such that the divergence matches generally the shape of said growing shell of solidified metal.

* * * * *